United States Patent [19]

Fineo

[11] 4,025,009

[45] May 24, 1977

[54] BLANKET OR SHEET WINDING APPARATUS

[75] Inventor: Carlo Fineo, Denver, Colo.

[73] Assignee: Johns-Manville Corporation, Denver, Colo.

[22] Filed: Jan. 20, 1975

[21] Appl. No.: 542,475

[52] U.S. Cl. ..... 242/66; 242/75.5

[51] Int. Cl.[2] ..... B65H 17/12; B65H 25/22

[58] Field of Search ..... 242/65, 66, 75.5–75.53

[56] References Cited

UNITED STATES PATENTS

| | | | |
|---|---|---|---|
| 1,258,644 | 3/1918 | Birch et al. | 242/66 |
| 1,353,948 | 9/1920 | Dutro et al. | 242/66 |
| 2,609,157 | 9/1952 | Asmussen et al. | 242/66 |
| 2,739,762 | 3/1956 | Cohn et al. | 242/75.5 |
| 3,239,161 | 3/1966 | Dutro et al. | 242/75.5 X |
| 3,282,526 | 11/1966 | Daly | 242/66 |
| 3,419,771 | 12/1968 | Bentley et al. | 242/75.51 X |
| 3,568,944 | 3/1971 | Besserdich | 242/66 |
| 3,658,272 | 4/1972 | Bennett et al. | 242/66 |

FOREIGN PATENTS OR APPLICATIONS

| | | | |
|---|---|---|---|
| 954,460 | 4/1964 | United Kingdom | 242/66 |

*Primary Examiner*—Stanley N. Gilreath
*Assistant Examiner*—John M. Jillions
*Attorney, Agent, or Firm*—Robert M. Krone; Joseph J. Kelly

[57] ABSTRACT

An apparatus for winding one or more continuous strips of sheet or blanket material, particularly very low density material, into one or more rolls on a rotatable mandrel comprising a drive means for rotating the roll(s) about the axis of the mandrel and means for supporting the roll(s) in such a manner that the roll(s) is pressed against a winding roller with an essentially constant force regardless of the size or weight of the roll(s). Also disclosed is a novel tensioning means. The apparatus eliminates telescoping of the roll ends, even on difficult to wind material.

13 Claims, 9 Drawing Figures

BLANKET OR SHEET WINDING APPARATUS

This invention relates to an apparatus for winding continuous or semi-continuous sheet or blanket material into rolls having square ends. The apparatus is particularly useful for winding sheet or blankets having low tear strengths.

BACKGROUND OF THE INVENTION

Sheets or blankets of such materials as paper, fiber glass, polyethylene, etc. are frequently manufactured continuously and are accumulated at the end of a process line into rolls by a winder. Usually, it is desired that the rolls be as compact as the tear strength of the material being wound will allow to conserve space in handling, storing, and shipping the rolled goods. It is also desirable, and usually essential, that the ends of the rolled goods be square.

To achieve the desired results, a winder must synchronize its linear take-up speed, regardless of the diameter of the rolled goods at the time, with the incoming speed of the sheet or blanket material from the process line. Failure to quickly compensate for changes in speed on the process line will either result in excess slack in the material being wound, usually causing telescoping of the roll, or will alternatively so stress or stretch the material to cause it to tear, disrupting the winding process and creating scrap material. The winder must not only be able to rapidly compensate for changes in speed during continuous operation, but also during startup and shutdown of the process.

Another requirement of the winder is that it permit rapid removal of finished roll goods from the winder and rapid initiation of a new roll to avoid slowing down or stopping the process line.

Still another requirement for the winder is that it apply a uniform and proper amount of tension to the sheet or blanket being rolled, particularly when the sheet or blanket is compressible and/or has low tear resistance. It is desirable that the amount of tension can be varied to permit the winder to wind different types of material having a wide range of tensile strengths or tear resistances.

It is also desirable that the winder be capable of compensating for variations in alignment of the sheet or blanket or for variations in the angle at which the sheet or blanket approaches the winder.

Finally, it is desirable that the winder be capable of applying only a desired amount of compression or load onto the roll of goods as it is being wound regardless of the density of the material being wound or the size of the roll at any point during the forming of the roll.

Finally, it is desired that the winder be able to compensate for misalignment or changes in alignment of the incoming sheet or blanket with respect to the winder and/or the partial roll of goods being wound. While prior art winders achieved some of these desirable features sufficient of the features were not obtained in sufficient degree to always permit square end roll packages to be achieved, particularly when winding sheet or blankets having very low tear strengths.

BRIEF SUMMARY OF THE INVENTION

Accordingly, the present invention provides an apparatus for winding one or more strips of continuous sheet or blanket material into one or more rolls, the width of each roll being essentially the same as the width of the strip contained in the roll, comprising a rotatable mandrel about which the one or more strips are wound to form one or more rolls; a drive means for rotating the one or more rolls about the axis of the mandrel, the drive means being adjustable to change the rotational speed of the one or more rolls and comprising at least one rotatable roller in contact with the outer surface of the one or more rolls; a movable tensioning surface for contact across the width of each of the one or more strips at a distance from the one or more rolls, the tensioning surface maintaining a level of tension in the one or more strips during formation of the one or more rolls; means for applying a desired amount of force to the tensioning surface to inhibit the movement of the tensioning surface away from said strip thus establishing the desired level of tension; control means for detecting any movement in the tensioning surface and responding to any such movement by adjusting the drive means to change the rotational speed of the one or more rolls in such a manner as to maintain the desired level of tension in the one or more strips regardless of changes in the linear speed of the one or more strips; and means for supporting the one or more rolls in such a manner that the one or more rolls are pressed against the at least one rotatable roller with a desired amount of force regardless of the size or weight of the one or more rolls. The apparatus may further comprise means for pivoting the tensioning surface and the mandrel horizontally to compensate for changes in the angle of the incoming one or more strips. The apparatus may additionally comprise means for moving the tensioning surface, the mandrel, and the at least one rotatable roller horizontally in a direction normal to the longitudinal center line of the one or more strips to compensate for shift in alignment in the incoming one or more strips.

The apparatus of the present invention eliminates telescoping in the winding of sheet or blanket materials. The apparatus winds these materials with essentially uniform tensioning forces on the material as it is being wound and essentially uniform compressive forces on the surface of the roll as it is being formed thereby producing a more perfectly round roll having square ends and an essentially uniform density throughout. Furthermore, the present invention automatically adjusts for changes in the linear speed of the incoming material and requires only simple adjustment to compensate for shifts in alignment and/or the orientation of the incoming material. Finally, the present apparatus permits rapid removal of the completed roll goods and rapid threading up to begin the new roll without the need for slowing down or stopping the process line producing the sheet or blanket material.

While the present invention can be used to wind a wide variety of sheet or blanket material, the apparatus is particularly useful in the winding of compressible blanket materials such as fiber glass blankets, especially relatively thin blankets having very low tensile strength and tear resistance. Typical of the latter material is air filtration media having an uncompressed thickness of about 0.65 cm, having a density of about 4.8 grams per sq. ft., and having a tensile strength of less than about 0.5 lbs. per inch of width in the longitudinal direction. The present invention has the flexibility and the features that allow such a fragile material to be wound into uniform rolls even though the thickness of a strip may occasionally vary from one longitudinal edge of the strip to the other longitudinal edge without tearing the material and requiring constant operator attention.

DETAILED DESCRIPTION AND PREFERRED EMBODIMENTS

The winding apparatus of the present invention is normally placed at the end of a processing line producing continuous or semi-continuous strip or strips sheet or blanket materials. In this specification a blanket material differs from a sheet material primarily in thickness. Whereas a sheet material is relatively thin, a blanket material can range in thickness up to several inches and frequently its thickness is compressible.

The process producing the sheet or blanket material normally would produce the material in continuous form, but since the material must be packaged in units, the continuous strip or strips are periodically severed into suitable lengths for packaging, thus the use of the term semi-continuous. The processing line producing the sheet or blanket material can be very complex, expensive, and costly to slow down or stop. Therefore, it is important that the winding apparatus be capable of winding the strip material in such a manner that the removal of finished rolls from the winder and the threading up to begin new rolls do not require a disruption in the strip forming process line.

Figure 1:
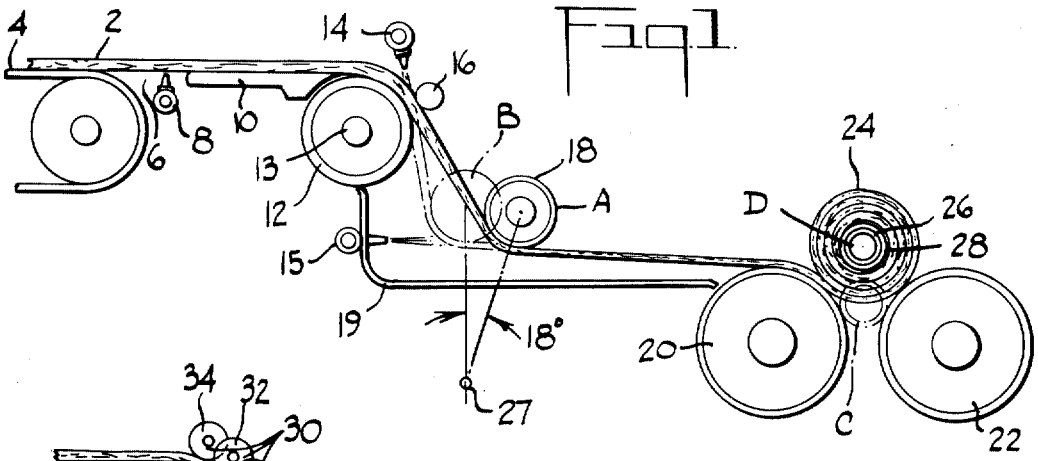
FIG. 1 is a side view of portions of the present apparatus showing the manner in which the strip is fed into the apparatus and is tensioned and wound according to the present invention.

Referring to FIG. 1, one or more strips of sheet or blanket material 2 are usually fed to the apparatus of the present invention by a conveyor 4, only the tail end of which is shown. The strip 2 advances across a gap 6 onto a slider plate 10. The strip 2 then passes over a support surface 12, which can be merely a curved surface or a driven or undriven roller, and under a guide 16. The strip 2 then passes under a tensioning surface 18, which can be merely a curved surface or a driven or undriven roller. The strip 2 next passes over winding roller 20 and is wound around mandrel 26, usually covered with a removable sleeve 28, into a roll 24. An optional second winding roller 22 is used in the preferred embodiment.

When a new strip is being fed into the apparatus of the present invention the leading edge is directed along a desired path using linear air jets 8, 14 and 15. As the leading edge of strip 2 is pushed beyond conveyor 4 and over the gap 6 the air jet 8 prevents the leading edge from dropping down into the gap and directs it onto surface 10. As the leading edge of strip 2 passes over the support surface 12 the linear air jet 14 directs the leading edge down between surface 12 and guiding surface 16. The leading edge 2 then proceeds downwardly towards a pan shaped guide 19 and is directed between the guide 19 and the tensioning surface 18 by the linear air jet 15. As the leading edge progresses towards the winding roller 20 the operator grasps the strip 2 and winds it around the mandrel 26 or the sleeve 28 manually for several turns after which the roll 24 makes good contact with winding roller 20 at which point the operator switches the winding apparatus to automatic winding mode. Once the winding apparatus is threaded the linear air jets are turned off. The air pressure in the manifolds feeding the linear air jets is adjustable and is adjusted to compensate for heavier or lighter strip materials.

Constant tension on the strip 2 being wound into roll 24 is maintained by tensioning surface 18. In the preferred embodiment, the tensioning surface 18 is pivoted about a point 27 located below pan 19 by the force exerted on the tensioning surface 18 by strip 2 caused by any difference in speed between winding roller 20 and the speed of the strip coming off of the conveyor 4. A force is applied to tensioning surface 18 at all times which, but for strip 2, would move the tensioning surface 18 to position B, shown in phantom lines in FIG. 1. This force is adjustable in order to apply the desired amount of tension in strip 2 being wound into roll 24. When the strip 2 coming off of conveyor 4 is running at a faster linear speed than the linear speed of winding roller 20 the above described force will move the tensioning surface 18 towards position B to maintain a constant tension in the strip 2 being wound. As the tensioning surface 18 moves towards position B, a control means will cause an increase in the linear surface speed of winder roll 20 and the tensioning surface will be moved back towards position A shown in FIG. 1 until the surface speed of winder 20 equals the linear speed of strip 2 coming off of conveyor 4. When, for any reason, the strip 2 coming off of conveyor 4 slows down below the linear surface speed of winding roller 20, this situation will tend to move the tensioning surface 18 towards winding roller 20. Such a movement will cause the control means to reduce the linear surface speed of winder roller 20 until its linear surface speed is equal to the speed of the strip 2 coming off of conveyor 4. In this manner a constant tension is maintained in strip 2 between tensioning surfaces 18 and winding roller 20, thus avoiding slack or tears in strip 2 due to changes in the linear speed of the strip coming off of process line via conveyor 4. The manner in which this is accomplished in the preferred embodiment will be described in detail later in the specification.

Figure 2:
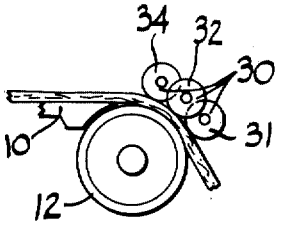
FIG. 2 is a partial view of an alternative embodiment of the apparatus shown in FIG. 1.

FIG. 2 illustrates an alternative manner of turning strip 2 around supporting surface 12. In this alternative embodiment a series of narrow overlapping rollers 28 are used in place of the linear air jet 14. A similar set of rollers could also be used in place of linear jets 8 and 15, but the linear air jets are preferred because they are less costly to make and operate. Mounted on axle 31 are rollers which are offset with respect to the rollers 30 mounted on axle 32 and therefore can overlap as shown. The same is true of the rollers 30 mounted on axles 32 and 33.

Figure 3:
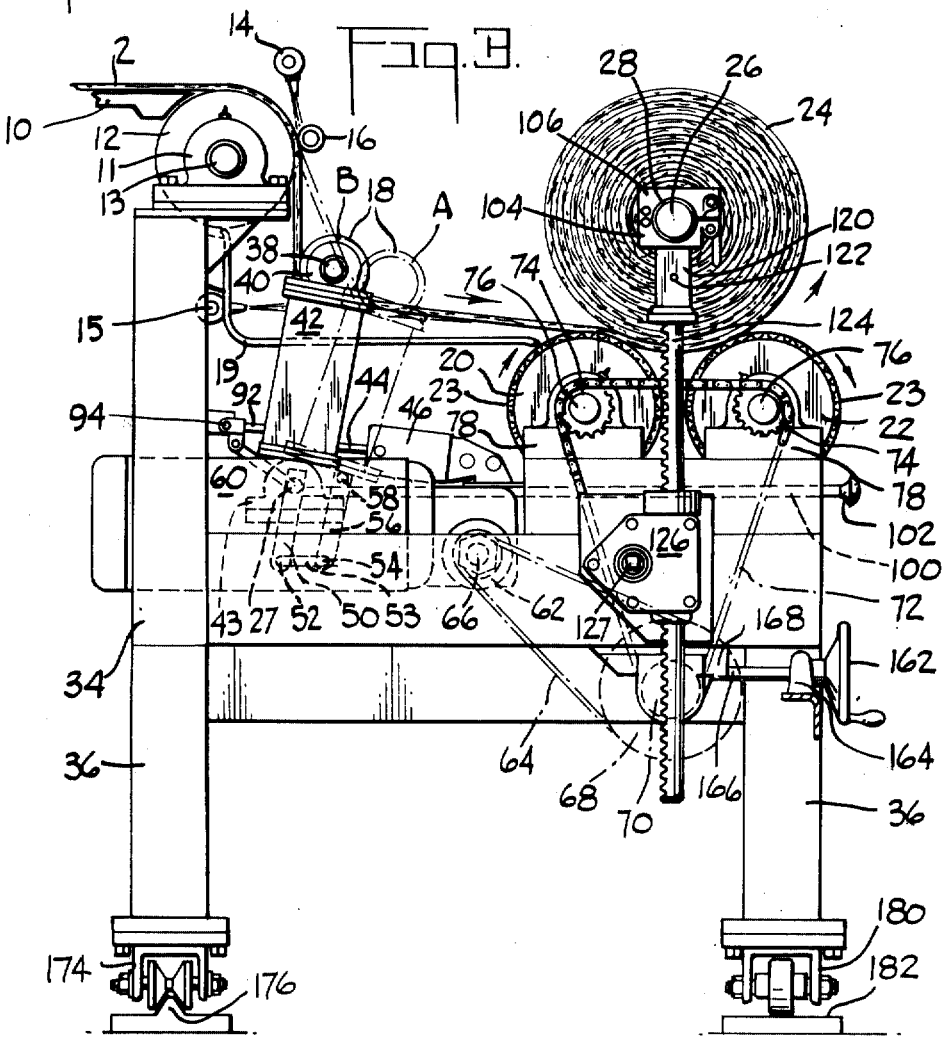
FIG. 3 is a side view of a preferred embodiment of the present invention.

FIGS. 3–7 illustrate the preferred embodiment of the present invention. Referring to FIG. 3, the supporting surface 12 is driven roller mounted on shaft 13 which rides in pillow block bearings 11 mounted to upper frame 34. Roll 12 is driven by a chain attached to the tail pulley of conveyor 4 (not shown) in such a manner that the surface speed of roller 12 is the same as the surface speed of conveyor 4. The guide means 16 is a small pipe extending across the width of the surface 12 and spaced therefrom by arms (not shown). The tensioning surface 18 is an undriven roller mounted on shaft 38 which is supported on pillow block bearings 40 mounted on arms 42. Arms 42 are rigidly connected to a shaft 27 which is supported by pillow blocks 43 mounted on upper frame 34. Thus, the tensioning surface 18 pivots about shaft 27 which rotates during pivoting. Linkage arm 50 is rigidly connected to shaft 27 and pivotally connected to linkage arm 56 by connecting arm 53 and pins 52 and 54. In turn, linkage arm 56 is rigidly connected to shaft 58. Thus, as shaft 27 rotates due to the pivoting of tensioning surface 18 the above described linkage causes shaft 58 to rotate in the same direction an amount dependent upon the degree of pivoting of tensioning surface 18.

Shaft 58 is a control shaft for a variable speed drive 60, e.g., a Floyd drive manufactured by the Floyd Drives Company, Denver, Colo. In the apparatus illustrated in FIG. 3, as shaft 58 is rotated counter clockwise it causes the output shaft 66 of the variable speed drive 60 to increase in RPM, and clockwise rotation of shaft 58 causes a decrease in the RPM of output shaft 66. Shaft 66 turns sprocket 62 which in turn rotates sprocket 68 via chain 64. Sprocket 68 rotates the smaller sprocket 70 which in turn rotates sprockets 74 via chain 72. Sprockets 74 are rigidly connected to shaft 76 supported by pillow blocks 78 mounted on upper frame 34. The shafts 76 are also rigidly connected to the winding rollers 20 and 22. The previously described mechanism controls the linear surface speed of winding rollers 20 and 23 in response to pivotal movement of tensioning surface 18.

Preferably the winding rollers 20 and 22 have a roughened outer surface 23, e.g., an outer layer of expanded metal, to provide additional traction between the winding roller surface and the strip material 2 running against the winding rollers. The linkage 50, 53, and 56 could be replaced with equivalent mechanisms for rotating one shaft in response, and in proportion to, the rotation of the second shaft. Also, to prevent damage to equipment in the event that the winding rollers should become locked in position for any reason, a conventional torque limiter can be installed between sprocket 62 and shaft 66. This would allow shaft 66 to continue to rotate, thus protecting the motor on the variable speed drive 60, even if sprocket 62 was locked in a fixed position.

In order to maintain a constant tension in the strip 2 between the tensioning surface 18 and winding roller 20, the tensioning surface 18 is biased towards position B shown in FIGS. 1 and 3 by an air cylinder 46 mounted at one end on frame 34 with pin 48 and clevis 49 and on the rod end 44 to the tensioning arm 42 by pin 45 and clevis 43. By adjusting the air or hydraulic pressure in cylinder 46 the amount of tension applied to strip 2 by tensioning surface 18 can be adjusted. Once set, the level of tension remains constant because tensioning surface 18 is permitted to pivot to take up slack or to relieve excess tension in the strip 2 as the linear speed of strip 2 coming off of belt 4 differs from the linear speed of winding surface 20.

Figure 6:
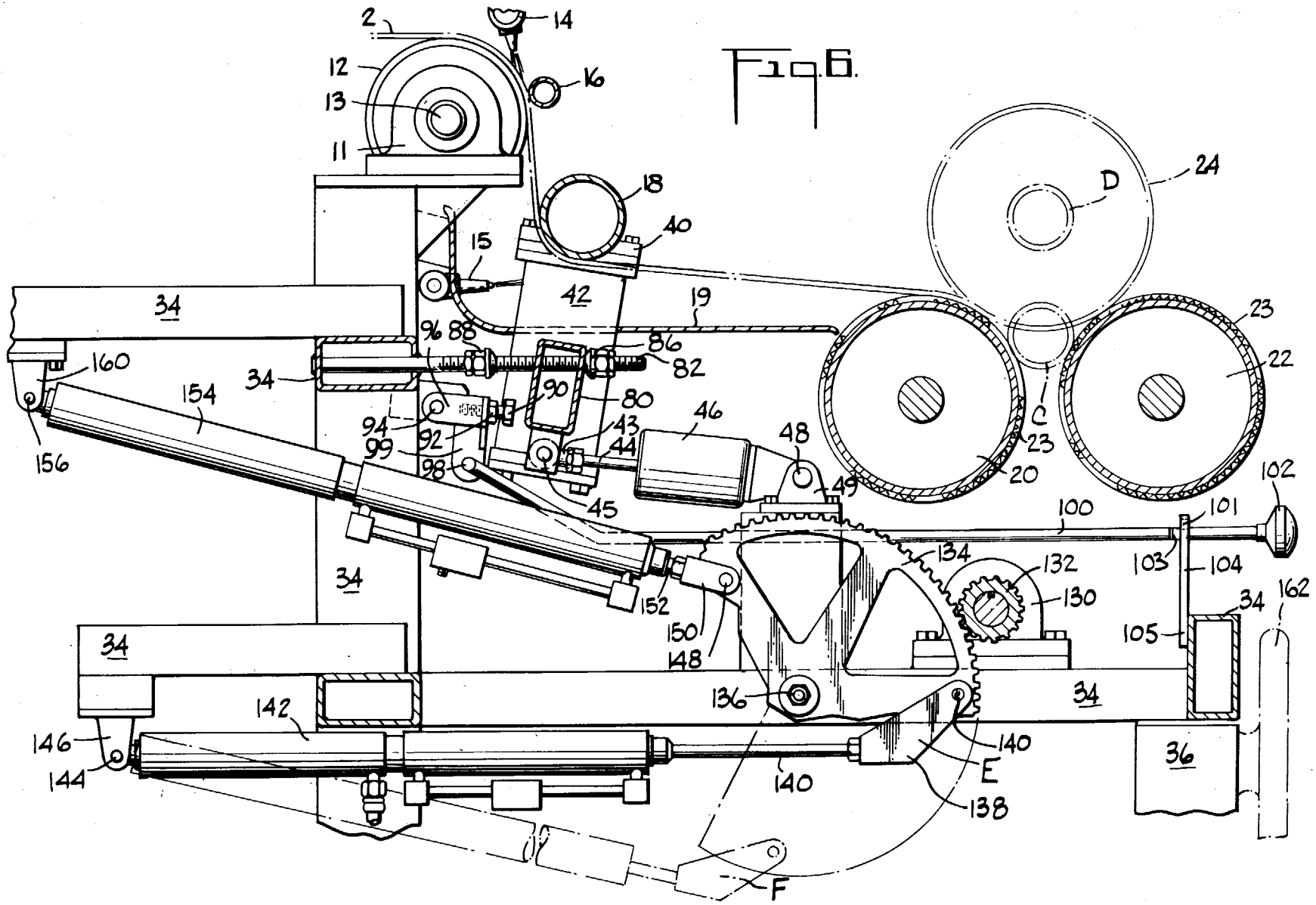
FIG. 6 is an enlarged partial cross sectional view taken along line 6—6 in FIG. 7.
Figure 7:
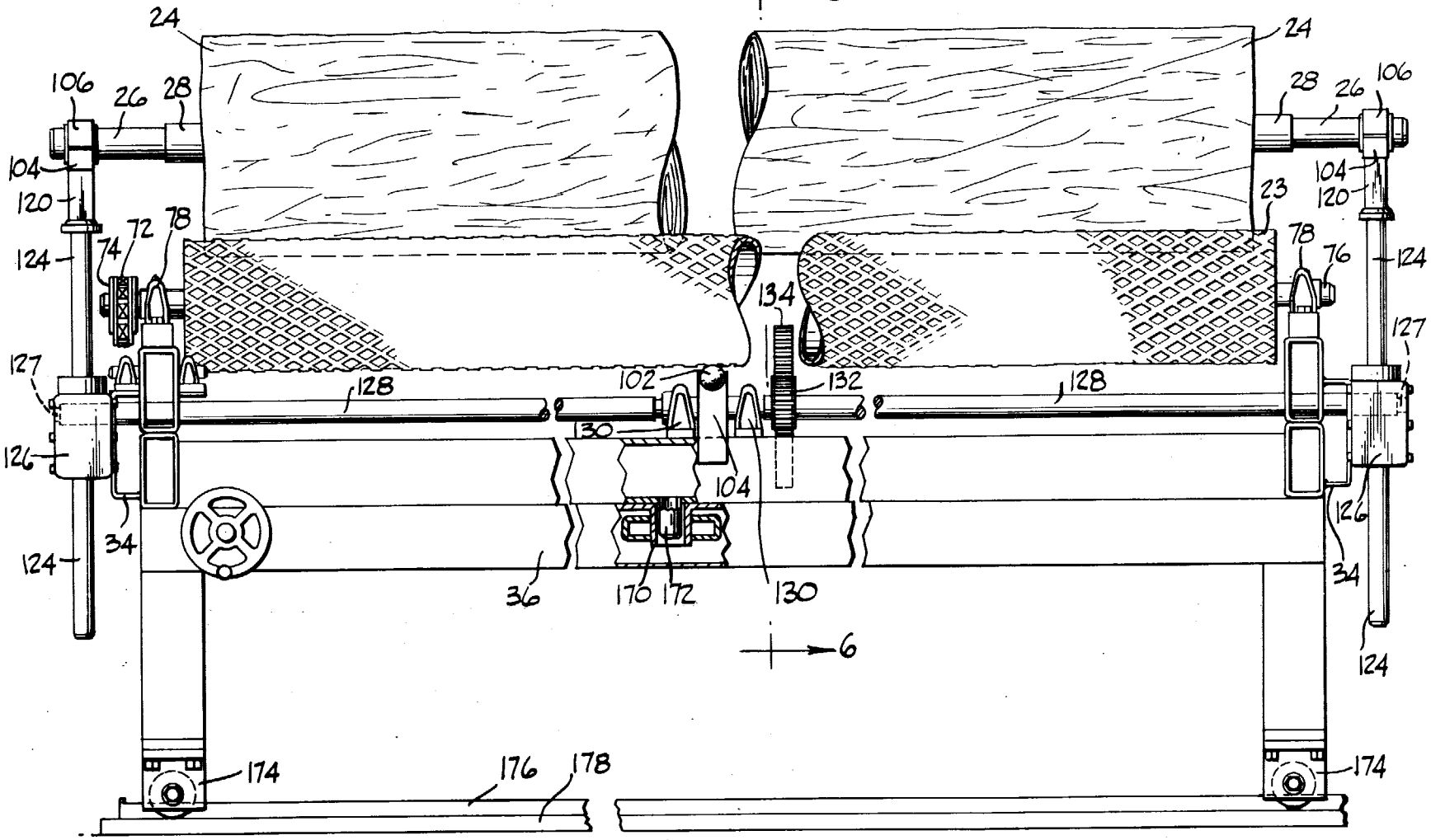
FIG. 7 is a front view of the apparatus of FIG. 3, broken for illustrative purposes and partially cut away to illustrate one of the features of the present invention.

The total pivotal movement of tensioning surface 18 is adjustably limited by the mechanism best shown in FIG. 6. A tubular member 80 joins the two pivot arms 42. Passing through slots in the tubular member 80 is a threaded rod 82 which is rigidly attached to upper frame member 34 by welding or other suitable means. Outside of tubular member 80 two nut stops 88 and 86 are positioned along rod 82. Nut stop 86 limits position A of tensioning surface 18 and is normally set to produce a linear surface speed on winder roll 20 of about 0 RPM or just slightly above. Nut stop 88 is spaced along rod 82 at a point that will provide the desired maximum speed limitation. Preferably, stop 88 is adjusted to provide a linear surface speed of winder roll 20 that is much higher than the normal speed of belt 4. This feature permits the operator to finish a completed roll, remove the roll, insert a new mandrel, and thread up the new mandrel without slowing down or stopping the main process line. The manner in which this is accomplished will be described in more detail later in the specification in the description of the operation of the apparatus of the present invention.

The slots in tubular member 80 through which rod 82 passes should be sufficiently large so that the surface of rod 82 never contacts the edges of the slots, but sufficiently small that nut stops 86 and 88 do not enter the slots or become wedged in the openings of the slots. Further, it is preferred that tubular member 80 be no heavier than is necessary to provide the structural support needed for arms 42, particularly for winding light weight material.

A further adjustable stop or limit is provided for tensioning surface 18. This adjustable limiting means is best shown in FIG. 6. The bolt head stop 90 is adjustable by rotating threaded portion 92 which is threaded through arm 96 which is pivoted on pin 94. The stop represented by bolt head 90 is designed to be in one of two positions. It is either in position to act as a maximum speed limit, in which case it would prevent the tensioning surface from moving all the way to the B position shown in FIG. 3, or it is in an inactive position, as shown in FIG. 6, where it provides no limitation on the movement of tensioning surface 18. Bolt head 90 is moved between these two positions by pulling and pushing knob 102 towards or away from the apparatus. Knob 102 is fastened to rod 100 which in turn is pivotally fastened to arm 99 which is rigidly fastened to arm 96. Arm 100 is further supported by bracket 104 which is fastened to upper frame member 34 at 105. Bracket 104 has a hole 101 therein through which rod 100 passes. Since the position shown in FIG. 6 for stop 90 is the normal running condition, rod 100 is turned down to a smaller diameter 103 where it passes through the hole 101 in bracket 104 at this position to prevent stop 90 from accidentally being moved to its alternate position during running of the apparatus. Further details on the reasons for stop 90 will be provided later in the specification in the description of the operation of the present apparatus.

During winding of the roll 24 the mandrel 26 moves vertically upward from position C, best shown in FIG. 6, to position D as the roll becomes greater in diameter. Also the weight of roll 24 increases as the roll size increases. If the material being wound is compressible, the weight of the roll tends to flatten out the roll where it contacts winding rollers 20 and 22, thus presenting a noncircular surface to the incoming strip 2. This situation frequently causes telescoping of the roll, an undesirable result.

The winding apparatus of the present invention eliminates this problem by supporting the mandrel 26 in such a manner that the mandrel and roll 24 present a constant downward force onto winding roll 20 and 22 at all times during the winding of roll 24. The downward force can be adjusted to any desired level, thus eliminating the tendency of roll 24 to be mashed flat where it contacts winding rollers 20 and 22 by the downward forces caused by the weight of roll 24.

To accomplish this result mandrel 26 is supported at each end of the winding apparatus (see FIGS. 3 and 7) by vertically moving supports 124. In the preferred embodiment shown in the drawings, these vertical supports 124 are in the form of toothed racks. Each of the toothed racks 124 extend through a conventional actuator such as a POWER LIFT actuator available from Power Components, Inc., Dearborn, Michigan. The actuators 126 are actuated by the rotation of shaft 128 having square ends 127. Although shaft 128 can be made in one piece, it is preferred to make shaft 128 in two pieces, to support these shafts on pillow block bearings 130 mounted to upper frame 34, and to connect these two shafts with a conventional shaft connector (not shown) located behind bracket 104 in FIG. 7. Thus the two shafts 128 act as a single shaft.

Toothed gear 132 is fixedly attached to shaft 128. Referring to FIG. 6, toothed gear 132 meshes with a gear sector 134 pivoted on a pin 136 mounted on upper frame 34. The gear sector 134 is caused to rotate about pin 136 by cylinders 154 and 142. Although either air or hydraulic cylinders can be used for cylinders 142 and 154 the more steady action of a hydraulic cylinder is preferred. To obtain a steady action of a hydraulic cylinder while utilizing the less expensive power source of plant compressed air, it is preferred to use conventional air over hydraulic cylinders, such as those shown in FIG. 6. Cylinders 142 and 154 are mounted at one end to upper frame member 34 by pin 144 and clevis 146, and pin 156 and clevis 160 respectively. The rod ends of cylinders 142 and 154 are attached to the gear sector 134 near its extremities by clevis 138 and pin 140, and clevis 150 and pin 148 respectively. The extension of rod 152 on cylinder 154 and the corresponding retraction of rod 140 on cylinder 142 causes the gear sector 134 and the clevis 138 connected thereto to rotate from position E to position F, shown in FIG. 6. The rotation of the gear sector 134 in this manner also causes a rotation in the opposite direction of gear 132 and shaft 128 which in turn causes toothed rack supports 124 to move upward vertically thus lifting mandrel 126 and roll 24 (see FIGS. 3 and 7). Cylinder 142 operates as a control cylinder and cylinder 154 acts as counterweight cylinder to offset the tendency of gear sector 134 from rotating counter-clockwise due to the downward forces on rack supports 124 caused by their weight and the weight of mandrel 26.

Cylinder 154 is so arranged that its moment arm about the axis of pin 136, remains close to constant during rotation of gear sector 134 from position E to position F, i.e., during winding of a roll. Actually, as the gear sector moves from position E to position F the moment arm or effective force of cylinder 154 on the gear sector decreases slightly (see *Womack Fluid Power Data Book*, page 8, published by Womack Educational Publications, Dallas, Tex.), but this slight decrease is acceptable when the density of the material being wound is at least about 4.5 gm/ft$^2$. By adjusting the air pressure to cylinder 154 to counter balance the force tending to rotate gear sector 134 counterclockwise caused by the weight of mandrel 26, toothed racks 124, etc. Thus, the weight of these elements are neutralized during the entire winding cycle and there should be no need to change the pressure to cylinder 154 unless the weight of one or more of these elements changes.

Cylinder 142 is arranged so that its moment arm about the axis of pin 136, increases, preferably linearly and at a rate equivalent to the rate of weight increase of the rolled goods as the diameter of the roll goods increases, during winding of the roll. The pressure to cylinder 142 can be varied to compensate for changes in density of the material being wound and to vary the force required to cause mandrel 26 to move upward. Some downward force by roll 24 onto surfaces 23 is necessary to provide adequate traction between surfaces 23 and strip 2, e.g., 2–10 lbs. The pressure applied to cylinders 142 and 154 work to extend rod 152 and to retract rod 140 during winding of a roll 24. When a mandrel is installed the pressure is directed to opposite ends of the cylinders to cause gear sector to move from position F to position E which moves the mandrel from position D to position C.

Thus with the above described arrangement the downward forces that roll 24 exert on surfaces 23 of rolls 20 and 22 can be maintained essentially constant regardless of the size of roll 24 and can be caused to be less than the force that would be produced by the weight of roll 24, or greater than such a force. With this arrangement mandrel 26 responds to upward force, i.e., caused by the increasing diameter of roll 24 during winding, applied anywhere along the length of the mandrel thus keeping the mandrel parallel to the at least one winding roller 20. This is important because it permits a squared end roll to be made even though the strip 2 is occasionally significantly thicker on one longitudinal edge than on the other.

Figure 4:
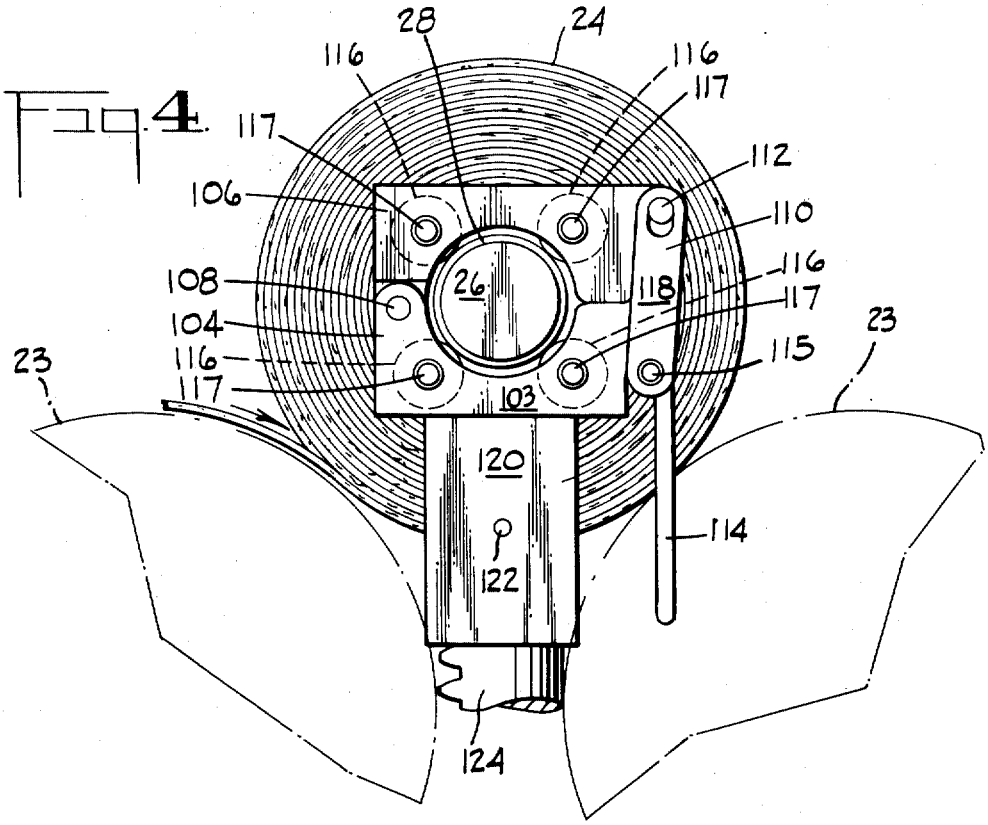
FIG. 4 is an enlarged partial side view of the apparatus of FIG. 3 showing one of the mandrel supports.
Figure 5:
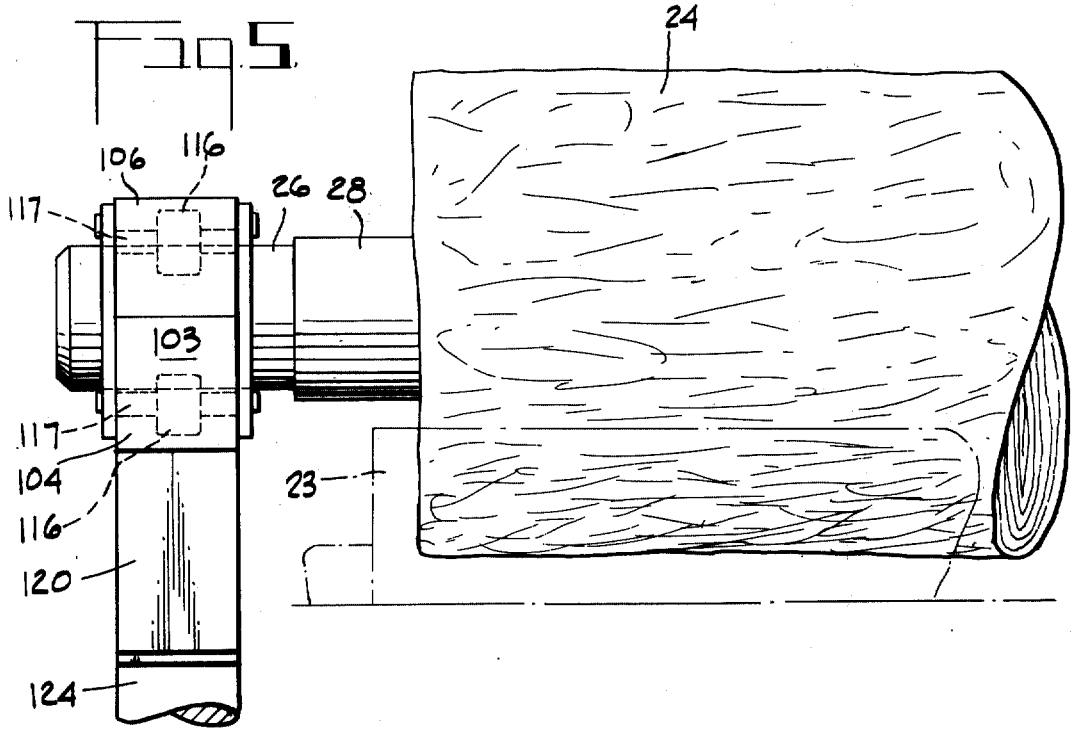
FIG. 5 is a partial elevational rear view of the apparatus of FIG. 3 enlarged to show one of the mandrel supports.

Because it is desirable that the mandrel 26 be quickly removable from its vertical supports 124 quick disconnect mandrel supports 103 are provided for each of the vertical rack supports 124. These quick disconnect mandrel supports 103 are best shown in FIGS. 4 and 5. The quick disconnect mandrel supports 103 are comprised of a lower member 104 and an upper member 106 hinged together on one side by pin 108 to allow the upper member 106 to be pivoted away from mandrel 126 so that the mandrel can be lifted out of support 103. A latch member 110 is located on the opposite end of support 103 and is connected to the upper member 106 by pin 112. A handle 114, pivotable on latch member 110 by pin 115, has on one end a conventional cam surface (not shown) which when rotated from a horizontal into a vertical position presses against a conventional shoulder on lower member 104 (not shown) to lock the upper member 106 into a closed or running position. When it is desired to remove the mandrel from the mandrel support 103, handle 114 is manually rotated from its vertical position in FIG. 4 to a horizontal position and pulled away from lower member 104 to unlock upper member 106 for rotation away from mandrel 26.

Roller bearings 116 are mounted in upper member 106, and the lower member 104, with pins 117 to facilitate easy rotation of mandrel 26. The mandrel support 103 is mounted on the vertical rack supports 124 with connectors 120 which slip over rack members 124 and are pinned thereon with pins 122.

Referring to FIG. 3, all of the apparatus described thus far is mounted on frame member 34. Upper frame member 34 sets on lower frame member 36 and is held in alignment therewith by pin 172 which is connected to upper frame member 34 (see FIG. 7). The pin 172 fits into a receptable 170 mounted on the lower frame member 36 and is rotatable therein. Shifts in the incoming strip 2 which would tend to change the angle of the incoming strip 2 with respect to the axis of mandrel 26 can be compensated for by pivoting the upper frame member 34 with respect to the lower frame member 36. This is accomplished by rotating hand wheel 162 which is supported by pillow block 164 mounted on lower frame member 36. Rotation of the hand wheel 162 rotates a threaded shaft 166 which passes through a threaded block 168 rigidly attached to upper frame member 34. This rotation of the hand wheel 162 and the shaft 166 pushes, or pulls, on the threaded block 168 causing the upper frame member 134 to pivot around the axis of pin 172, while the lower frame member 36 remains in a fixed position. Although this pivoting feature, as illustrated, requires the manual efforts of the operator, it would be within the ordinary skill in the art to automate this function by using detectors to detect the position of incoming strip 2 on belt 4 and use these detectors to control a reversible motor for driving hand wheel 162 in either direction to maintain the proper relationship between strip 2 and mandrel 26.

The winding apparatus of the present invention is preferably mounted on casters 174 and 180 running on rails 176 and pad 182 respectively, to allow the winding apparatus to be moved perpendicularly to the normal direction of movement of strip 2. This feature would allow the winder to compensate for any changes in lateral alignment of strip 2 on belt 4 and to compensate for different width strips being produced. Although not shown, the apparatus can also be equipped with a conventional locking device to lock the winder in a fixed position along the length of rail 176.

In the operation of the apparatus, a mandrel 26, usually fitted with removable sleeves such as paper or cardboard, is placed in the mandrel supports 103. The control cylinder 142 and the counter balance cylinder 154 are then manipulated to move the mandrel 26 into the position C, shown in FIG. 6. In position C there is sufficient clearance between the surface of the mandrel 26 or the sleeve 28 and the surfaces 23 of winding rollers 20 and 22 to permit the strip 2 to pass therethrough and make several turns around mandrel 26 or sleeve 28 before the surface of the roll would contact surfaces 23. The cylinders 142 and 154 are then switched back to running mode. Under these conditions the mandrel would remain in position C until an upward force of a desired magnitude is exerted on mandrel 26 by roll 24 bearing against the at least one winding roller 20.

Next the motor driving the variable speed drive 60 is energized causing rollers 20 and 22 to begin rotation. The desired pressure is set on cylinder 46 to provide the desired level of tension in the strip to be wound which causes tensioning surface 18 to move to position B and against stop 88 since strip 2 is not yet threaded up on mandrel 26. In position B the linkage 50, 53, and 56 cause the variable speed drive to turn the winding rollers 20 and 22 at maximum speed according to the position of stop 88 on rod 82. However, it is desired that the winding rollers 20 and 22 run at only an intermediate speed, which speed is about the normal speed of the strip coming off of belt 4, during threading up of the machine. To achieve this, knob 102 is lifted slightly and pulled outward which raises stop 90 into a position intermediate stops 86 and 88 and moves tensioning surface 18 intermediate between positions A and B because of the contact between stop 90 and channel member 80.

Next, the air supply is turned on for the linear air jets 8, 14, and 15. Strip 2 is then fed into the winding apparatus in the manner previously described in the specification and manually wound around mandrel 26 or sleeve 28 several times to lock the strip 2 onto the mandrel and to build up a sufficient size roll 24 to contact surfaces 23 on winding rollers 20 and 22. At this point the winding rollers take over the turning of roll 24 and the operator pushes knob 102 forward until notch 103 is lined up with the hole 101 in bracket 104. At this point, tensioning surface 18 is pushed into strip 2 by cylinder 46 causing rollers 20 and 22 to increase in speed until an equilibrium is reached and a tension in strip 2 between tensioning surface 18 and roller 20 equals the desired level set by the pressure setting on cylinder 46. This tension will be maintained constant by the tensioning surface 18, the constant pressure in cylinder 46, and the linkage between shaft 27 and the variable speed drive 60. Also, as roll 24 builds up and exerts a downward force against winding rollers 20 and 23 that just exceeds the force created by the combined pressures in cylinders 142 and 154, mandrel 26 will be lifted upwardly to maintain a constant force against the surface of roll 24 by surfaces 23 at all times during the forming of the roll. Once the winder is threaded up and put into running mode, the air supply to linear air jets 8, 14, and 15 is turned off. During winding of the roll, any changes in alignment between strip 2 and mandrel 26 can be compensated for by the operator by turning hand wheel 162 in the proper direction and the proper amount or by moving the winder along rail 176 or both.

When the roll is almost completed, a conventional cutter (not shown) located somewhere along belt 4 will cut strip 2 across its width. When this occurs, strip 2 will go slack against tensioning surface 18 causing tensioning surface 18 to move into position B. This causes the winding rollers 20 and 22 to go to maximum speed, which is much faster than the linear speed of belt 4, sliding the cut portion of the strip 2 over belt 4 and roller 12. Thus, winding of roll 24 will be completed before the new end of strip 2 for the next rolls reaches the end of belt 4. In the meantime, the finished roll 24 and mandrel 26 are removed from the mandrel supports 103 and a new mandrel is inserted. By the time this is completed, the new end of strip 2 will be approaching the mandrel 26 and it can be threaded into the winding apparatus as previously described.

While the above described operation of the winding apparatus assumed a single strip being wound into a single roll in the winder, it is too be understood that two or more parallel strips can be wound simultaneously into two or more rolls on the same winder along a common mandrel.

Figure 8:
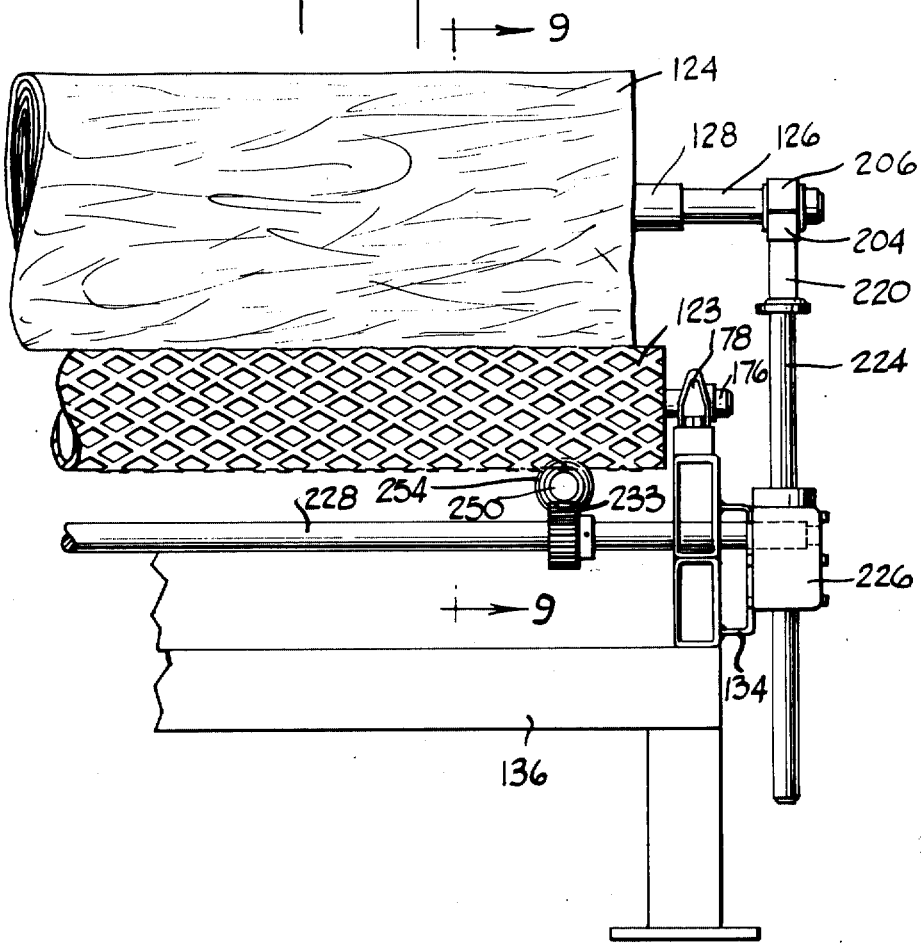
FIG. 8 is a partial front view of a modified form of the apparatus of the present invention.
Figure 9:
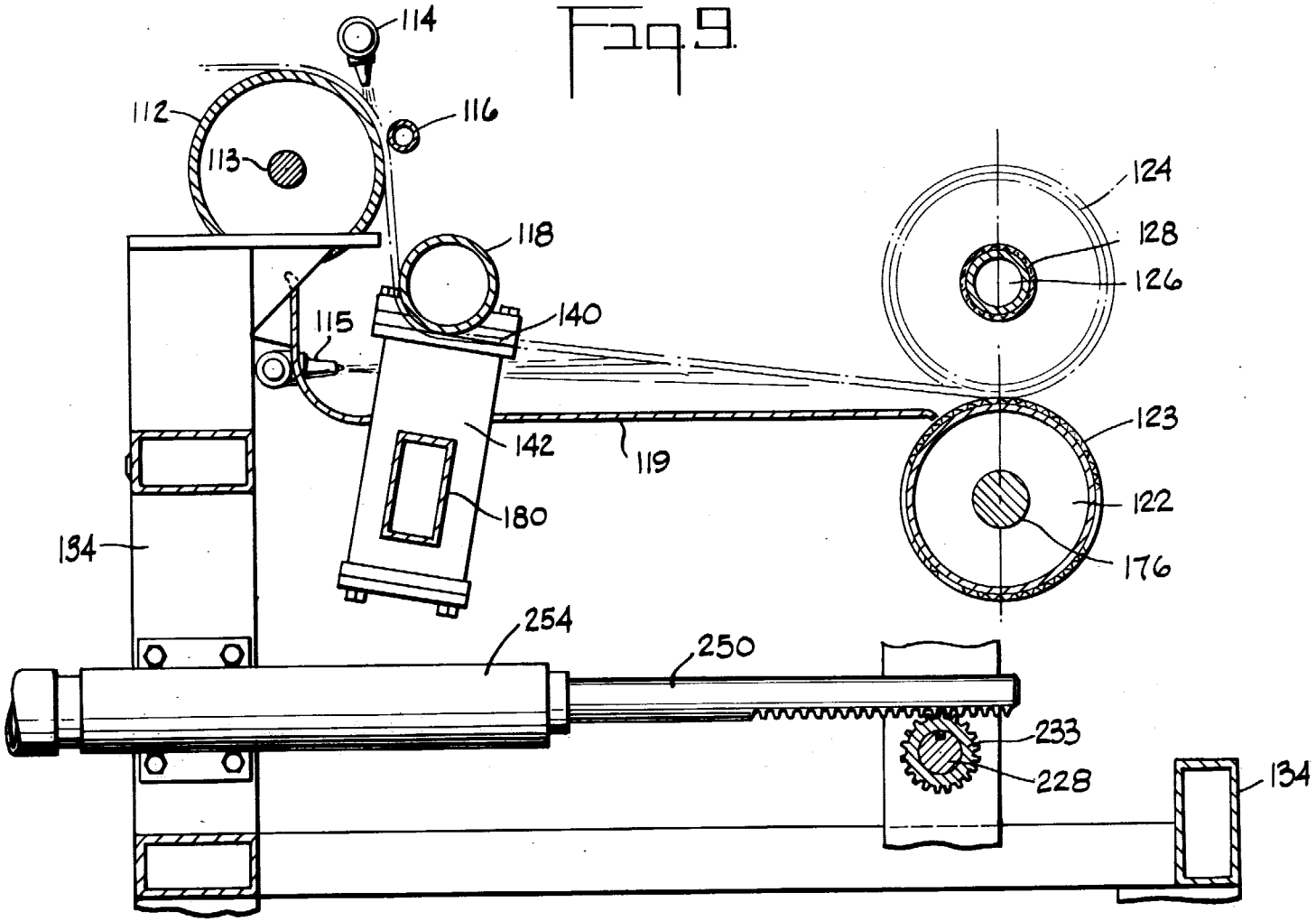
FIG. 9 is an enlarged partial cross-section of the apparatus illustrated in FIG. 8 viewed along lines 9—9.

FIGS. 8 and 9 illustrate a modified form of the apparatus illustrated in FIGS. 1–7. This apparatus has two modifications, but either modification can be made independently of the other. In FIGS. 8 and 9 elements that are the same or similar to the same elements shown in FIGS. 1–7 are referenced by numerals that are 100 higher than the reference numerals used in FIGS. 1–7.

The first modification is the use of a single drive roller 122 instead of the two drive rollers 20 and 22 used in the apparatus illustrated in FIGS. 1–7. The use of a single drive roller 122 makes it easier to thread up a new strip(s) on the mandrel 126. While FIG. 9 shows the axis of drive roller 122 vertically aligned with the axis of mandrel 126, this isn't necessary so long as the surface 123 of drive roller 122 can contact the outer surface of roll 124.

The second modification is the shown removal of counterbalance cylinder 154, in FIG. 6, from gear sector 134 and the addition of a similar counterbalance cylinder, in this case 254, at a different location along shaft 228. At that point on shaft 228 a second toothed gear 233 is mounted. Counterbalance cylinder 254 has a toothed rod 250 designed to mesh with gear 233. With this arrangement the counterbalance force exerted by cylinder 254 on shaft 228 remains constant throughout the cycle of gear sector 134 from position E to position F. This embodiment is especially useful in the winding of extremely lightweight materials.

In describing the invention certain embodiments have been used to illustrate the invention and the practice thereof. However, the invention is not limited to these specific embodiments as other embodiments and modifications within the spirit of the invention will readily occur to those skilled in the art on reading the specification. The invention is thus not intended to be limited to the specific embodiment disclosed, but instead is to be limited only by the claims appended hereto.

What I claim is:

1. Apparatus for winding one or more strips of continuous sheet or blanket material into one or more rolls, the width of each of said rolls being essentially the same as the width of the strip contained in said roll, the apparatus comprising:

a. a rotatable mandrel about which one or more strips are wound to form one or more rolls;

b. a drive means for rotating said one or more rolls about the axis of said mandrel, said drive means comprising at least one rotatable winding roller in contact with the outer surface of said one or more rolls;

c. means for supporting said one or more rolls in such a manner that said one or more rolls is pressed against said at least one rotatable winding roller with a desired force regardless of the size or weight of the one or more rolls, said supporting means comprising:

i. mandrel supports located to be near each end of the mandrel, said mandrel supports being movable simultaneously vertically upward in response to an upward force exceeding a desired magnitude applied anywhere along the length of the mandrel;

ii. means for exerting an essentially constant upward force on said mandrel supports generally equal to the weight of said mandrel and said mandrel supports regardless of the position of said mandrel supports;

iii. means for exerting a variable upward force on said mandrel supports, with the magnitude of said variable force increasing as the distance between the axis of said mandrel and the axis of said at least one winding roller increases; and iv. one or more shafts acting as a single shaft through which said forces are exerted by said means (ii) and (iii), said means (ii) and (iii) being located below a horizontal plane substantially near the axis of said mandrel when said one or more rolls are being wound.

2. An apparatus as defined in claim 1 wherein said means (c,ii) comprises a toothed sector gear, the rotation of which causes said mandrel supports to move along a vertical plane, and a force exerting means connected to said sector gear in such a manner that the moment arm of said force exerting means changes only a small amount as said sector gear rotates.

3. An apparatus as defined in claim 1 wherein said means (c,iii) comprises a toothed sector gear, the rotation of which causes said mandrel supports to move along a vertical plane, and a force exerting means connected to said second gear in such a manner that the moment arm of said force exerting means increases as said sector gear rotates in the direction that causes said mandrel supports to move vertically upward.

4. An apparatus as defined in claim 2 wherein said means (c,iii) comprises a force exerting means connected to said sector gear in such a manner that the moment arm of this force exerting means increases as said sector gear rotates in the direction that causes said mandrel support to move vertically upward.

5. An apparatus as defined in claim 3 wherein said moment arm increases in a linear fashion and wherein said means (c,ii) comprises a toothed gear, the rotation of which causes said mandrel supports to move along a vertical plane, and a force exerting means meshed with said toothed gear in such a manner that the moment arm of said force exerting means remains essentially constant as said toothed gear rotates.

6. An apparatus as defined in claim 4 wherein said moment arm increases in a linear fashion.

7. Apparatus for winding one or more strips of continuous sheet or blanket material into one or more rolls, the width of each of said rolls being essentially the same as the width of the strip contained in said rolls, the apparatus comprising:

a. a rotatable mandrel about which said one or more strips are wound to form one or more rolls;

b. a drive means for rotating said one or more rolls about the axis of said mandrel, said drive means being adjustable to change the rotational speed of said one or more rolls, said drive means comprising at least one rotatable winding roller in contact with the outer surface of said one or more rolls;

c. a movable tensioning surface means for contact across the width of each of said one or more strips at a distance from said one or more rolls, said tensioning surface maintaining a level of tension in said one or more strips during formation of the one or more rolls;

d. means for applying a desired amount of force to said tensioning surface to inhibit the movement of said tensioning surface thus establishing said level of tension;

e. control means for detecting any movement in said tensioning surface and responding to any such movement by adjusting said drive means to change the rotational speed of said one or more rolls in such a manner as to maintain the desired level of tension in said one or more strips regardless of changes in linear speed of said one or more strips;

f. means for supporting said one or more rolls and means for exerting an upward force on said supporting means in such a manner that said one or more rolls is pressed against said at least one rotatable winding roller with a desired essentially constant force regardless of the size or weight of the one or more rolls, said exerting means including one or more shafts acting as a single shaft through which said force is exerted, said exerting means being located below a horizontal plane substantially near the axis of said mandrel when said one or more rolls are being wound;

g. said tensioning surface means (c) comprising:
   i. a curved surface for contacting said sheet or blanket;
   ii. at least one support arm supporting said curved surface and fixedly attached to a longitudinal shaft member, said arm and member being pivotable about the axis of said member;
   iii. a variable speed drive having a control shaft and
   iv. linkage means for detecting rotational movement of said member and for causing said control shaft on said variable speed drive to rotate in a direction and in an amount to change the output speed of said variable speed drive to maintain said desired level of tension, which variable speed drive causes the rotation of means (f);

h. stop means for limiting the amount of pivotal movement of said support arm thereby limiting at least the maximum speed of the output shaft of said variable speed drive; and i. an intermediate stop means that can be moved into or out of position and when in position further limits the amount of pivotal movement of said support arm in a direction that would cause an increase in the output speed of the variable speed drive.

8. Apparatus for winding one or more strips of continuous sheet or blanket material into one or more rolls, the width of each of said rolls being essentially the same as the width of the strip contained in said rolls, the apparatus comprising:

a. a rotatable mandrel about which said one or more strips are wound to form one or more rolls;

b. a drive means for rotating said one or more rols about the axis of said mandrel, said drive means being adjustable to change the rotational speed of said one or more rolls, said drive means comprising at least one rotatable winding roller in contact with the outer surface of said one or more rolls;

c. a movable tensioning surface means for contact across the width of each of said one or more strips at a distance from said one or more rolls, said tensioning surface maintaining a level of tension in said one or more strips during formation of the one or more rolls;

d. means for applying a desired amount of force to said tensioning surface to inhibit the movement of said tensioning surface thus establishing said level of tension;

e. control means for detecting any movement in said tensioning surface and responding to any such movement by adjusting said drive means to change the rotational speed of said one or more rolls in such a manner as to maintain the desired level of tension in said one or more strips regardless of changes in linear speed of said one or more strips; and f. means for supporting said one or more rolls and means for exerting an upward force on said supporting means in such a manner that said one or more rolls is pressed against said at least one rotatable winding roller with a desired essentially constant force regardless of the size or weight of the one or more rolls, said exerting means including one or more shafts acting as a single shaft through which said force is exerted, said exerting means being located below a horizontal plane substantially near the axis of said mandrel when said one or more rolls are being wound;

g. said supporting means comprising:
   i. mandrel supports located to be near each end of the mandrel, said mandrel supports being movable simultaneously vertically upward in response to an outward force exceeding a desired magnitude applied anywhere along the length of the mandrel;
   ii. a means for exerting an upward force on said mandrel supports generally equal to the weight of said mandrel and said mandrel supports regardless of the position of said mandrel supports; and
   iii. means for exerting a variable upward force on said mandrel supports with the magnitude of said variable force increasing as the distance between the axis of said mandrel and the axis of said at least one winding roller increases, said means (ii) and (iii) being located below said horizontal plane.

9. An apparatus as defined in claim 8 wherein said means (f,ii) comprises a toothed sector gear, the rotation of which causes said mandrel supports to move along a vertical plane and a force exerting means connected to said sector gear in such a manner that the moment arm of said force exerting means changes only a small amount as said sector gear rotates.

10. An apparatus as defined in claim 8 wherein said means (f,iii) comprises a toothed sector gear, the rotation of which causes said mandrel supports to move along a vertical plane, and a force exerting means connected to said sector gear in such a manner that the moment arm of said force exerting means increases as said sector gear rotates in the direction that causes said mandrel supports to move vertically upward.

11. An apparatus as defined in claim 9 wherein said means (f,iii) comprises a force exerting means connected to said sector gear in such a manner that the moment arm of this force exerting means increases as said sector gear rotates in the direction that causes said mandrel supports to move vertically upward.

12. An apparatus as defined in claim 10 wherein said moment arm increases in a linear fashion and wherein said means (f,iii) comprises a toothed gear, the rotation of which causes said mandrel supports to move along a vertical plane, and a force exerting means meshed with said toothed gear in such a manner that the moment arm of said force exerting means remains essentially constant as said toothed gear rotates.

13. An apparatus as defined in claim 11 wherein said moment arm increases in a linear fashion.

* * * * *